US006073593A

United States Patent [19]

Nilson et al.

[11] Patent Number: 6,073,593

[45] Date of Patent: Jun. 13, 2000

[54] PLASTIC FAN AND THERMAL CLUTCH DRIVE

[75] Inventors: Carl A. Nilson, Jackson, Mich.; Lawrence C. Kennedy, Kettering, Ohio

[73] Assignee: Harvard Industries, Inc., Jackson, Mich.

[21] Appl. No.: 08/986,587

[22] Filed: Dec. 8, 1997

[51] Int. Cl.[7] ..... F01P 7/02

[52] U.S. Cl. ..... 123/41.12; 123/41.49; 416/169 A

[58] Field of Search ..... 123/41.12, 41.49; 416/169 A

[56] References Cited

U.S. PATENT DOCUMENTS 3,262,528 7/1966 Weir .
3,893,555 7/1975 Elmer ..... 123/41.12
4,169,693 10/1979 Brubaker .
4,238,016 12/1980 Yoshida et al. .
4,282,961 8/1981 Roscoe .
5,358,382 10/1994 Muhlbach .

*Primary Examiner*—Noah P. Kamen
*Attorney, Agent, or Firm*—Young & Basile, P.C.

[57] ABSTRACT

An internal combustion engine coolant fan assembly including a self contained thermally controlled clutch or externally controlled clutch having a housing and a fan blade assembly which is attached to the housing by a circular hub utilizing an interference fit or threaded connection. Preferably, the housing includes cooling fins, and the blade assembly circular hub is mounted on the outer edges of the cooling fins.

10 Claims, 3 Drawing Sheets

PLASTIC FAN AND THERMAL CLUTCH DRIVE

BACKGROUND OF THE INVENTION

1. Field of the Invention

The invention pertains to the mounting of a fan blade assembly to a thermally controlled or externally controlled drive clutch wherein the fan blade assembly includes synthetic blades and a hub capable of being placed upon the clutch body cooling fins.

2. Description of the Related Art

Internal combustion engines, including diesel engines, regulate the engine coolant temperature by the use of fan blades drawing or pushing air through a heat conducting radiator. As the rotation of the fan assembly requires considerable energy, for some time it has been popular to mount the fan or blade assembly upon a thermally controlled clutch or drive mechanism powered from the engine. The thermal clutch utilizes temperature sensitive control means either sensing the temperature of the ambient air, or the engine temperature, wherein the clutch drives the fan only when forced ventilation through the coolant radiator is required, for instance, when the vehicle is at rest or moving at low speeds, or under heavy load such as when climbing an incline.

A thermally controlled fan clutch usually permits the fan to be in a non-driven mode during normal vehicle movement as air will pass through the coolant radiator due to the vehicle movement thereby conserving energy and improving fuel efficiency.

The use of thermally controlled clutches and fan drive couplings is well known and a typical device is shown in U.S. Pat. No. 3,262,528. It is also known to use blade assemblies wherein the blades are formed of a synthetic plastic material as employed in conjunction with a thermally controlled clutch or coupling as shown in U.S. Pat. Nos. 4,169,693, 4,238,016, 4,282,961 and 5,358,382. However, in the known prior art, the mounting of the blade assembly upon the clutch is usually by means of threaded fasteners requiring expensive drilling and threading of the various components, and "bolt-on" blade assemblies may easily be misassembled or misaligned during assembly and installation and are subject to unloosing due to vibration, and the bolts add an objectionable axial length to the assembly.

OBJECTS OF THE INVENTION

It is an object of the invention to provide a thermally controlled internal combustion engine clutch having a blade assembly wherein such components can be accurately and quickly assembled in a positive manner without significantly adding to the clutch length.

A further object of the invention is to provide a thermally controlled internal combustion engine clutch having a blade assembly wherein the blade assembly includes blades formed of a synthetic material bonded to a metallic hub concentrically mounted on the clutch body fins' outer edges producing a very accurate concentric mounting of the blade assembly on the clutch body, and without adding to the overall axial length of the blade assembly and/or clutch body.

Another object of the invention is to provide an internal combustion engine cooling system consisting of a thermally controlled clutch and a blade assembly wherein the blade assembly includes synthetic blade elements molded upon a metallic hub, and the hub is mechanically attached to clutch cooling fins and assembly may be augmented by the forming of a lip on the blade assembly hub to cooperate with a shoulder defined on the thermal controlled clutch.

SUMMARY OF THE INVENTION

In most cases, a thermally controlled clutch or coupling in accord with the inventive concepts will be rotatably mounted on a vehicle for rotation through a belt driven by the associated internal combustion engine. The coupling includes an inner component drivingly connected to the vehicle engine by a drive belt or chain, and the clutch outer body portion is rotatably mounted upon the inner component and usually includes heat dissipating fins having outer edges. A thermally controlled control located within the clutch selectively interconnects the clutch inner component and body depending upon the temperature of the ambient air, or the vehicle engine temperature.

The clutch body includes an exterior surface, usually circular, concentric with the axis of body rotation, and in most instances, the exterior of the body includes a plurality of homogeneous coolant fins for dissipating heat. In the practice of the invention, the outer edges of the coolant fins are equally located from the body axis and constitute a mounting surface. Also, preferably, a shoulder is defined upon the body mounting surface including a radially extending surface adjacent the fins.

The blade assembly includes a plurality of synthetic plastic blades, and a metal hub component includes a plurality of radially extending projections which extend into the blades. The metal hub includes an annular collar element having an inner cylindrical surface of a diameter slightly less than the body mounting surface defined by the fins' outer edges.

In one embodiment of the invention, the blade assembly is mounted upon the clutch body by forcing the blade assembly hub mounting surface upon the fins' outer ends. The dimensions of the hub mounting assembly and the diameter of the fins is such as to produce an interference fit whereby the blade assembly will be firmly mounted upon the clutch body in a concentric manner.

To further enhance the mechanical connection between the blade assembly and the clutch body without the use of separate fasteners, the innermost edge of the blade assembly hub is rolled inwardly into axial alignment with the shoulder defined on the clutch body thereby preventing axial movement of the hub on the body in a direction which would permit these components to separate.

By utilizing an interference fit between the blade assembly and the clutch body, these components may be very quickly and accurately assembled in a concentric relationship, and by eliminating the need for separate fasteners, the likelihood of improper assembly is reduced, secondary machining operations such as drilling, tapping, and the like, are eliminated, noise generation reduced and the danger of loose parts due to vibration is removed. Further, the axial length of the assembly will be reduced allowing the assembly to function with less distance between the radiator and engine.

Rather than mounting the blade assembly upon the ends of the fins, it is also possible to mount the blade assembly by an interference fit on a clutch body wherein an outer circular surface has been formed specially for receiving the blade assembly inner diameter. In this manner, the aforementioned objects will continue to be achieved and the provision of a cylindrical periphery on the clutch body especially designed to receive the blade assembly results in an especially advantageous construction.

In other embodiments of the invention, rather than using an interference fit between the fin ends and the blade assembly, threads may be formed on the fin ends cooperating with an internal thread formed on the hub inner surface. In such instance, the hub will include a lip bent inwardly cooperating with a shoulder defined on the fins, or the end of the fins, to limit axial movement of the hub on the fins. Additional embodiments may include using an inwardly deformed lip at each end of the interference fit mounted hub to insure against axial relative movement between the hub and clutch body in the event that the interference relationship fails.

Another embodiment utilizing the inventive concepts employs an annular ring having bolts extending between the body fins threaded into a lip defined on the hub wherein the ring and the lip prevent relative axial movement between the hub and clutch body, and do not require an interference fit between these components.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENTS

Figure 1:
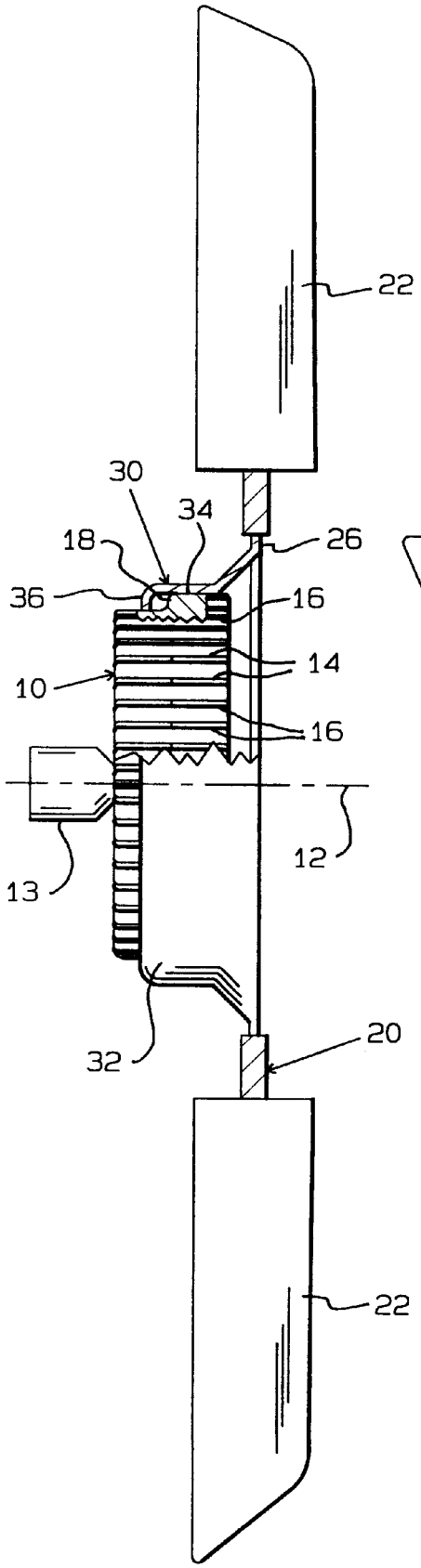
FIG. 1 is an elevational view, partially sectioned, illustrating a thermal clutch and a blade assembly in accord with the invention in an assembled relationship.

With reference to FIG. 1, a thermal controlled internal combustion engine coolant clutch or coupling body is shown at 10. The body has an axis of rotation as indicated at 12 and constitutes the external portion of the thermal clutch. The internal clutch mechanism, and the thermal actuation devices of the clutch are attached to a rotating drive shaft by an adapter 13 and constitute no part of the instant invention and may be similar to any of the devices shown in the aforementioned patents.

The body 10 preferably includes a plurality of circumferentially spaced cooling fins 14 evenly defined about the circumference of the body 10. The fins 14 are homogeneously cast from the metal of the body 10 and conduct heat to cool the rotor. The fins 14 are externally defined by ends 16, and the ends 16 are equally radially spaced from the axis 12 and are preferably formed with a relatively square end configuration as to together define a mounting surface of a generally cylindrical configuration.

As appreciated from FIG. 1, the fin configuration includes a radial shoulder 18 facing the inner or left end of the body for a purpose later described.

The blade assembly 20 includes a plurality of synthetic plastic fan blades 22 which extend from a circular ring 24. As appreciated from FIG. 2, the blades 22 may be asymmetrically circumferentially spaced for noise and vibration attenuation as known in the art.

The synthetic plastic ring 24 and blades 22 are mounted upon a metal hub which includes a plurality of radially extending projections 26 which extend into the blades 22 and are molded therein whereby the blades and the projections 26 form an integral connection. The projections 26 are formed or cast from the metal hub 30 which includes a cylindrical collar 32 having an inner cylindrical mounting surface 34 of a diameter slightly less than the diametrical diameter defined by the fin ends 16.

Accordingly, because of the dimensional relationship between the diameter of the hub collar mounting surface 34 and the diameter of the body mounting surface as defined by the fin ends 16, the collar 32 may be press fitted upon the fin ends 16 in an interference fit relationship firmly assembling the blade assembly 20 to the body 10 for rotation therewith. The interference fit between the hub and the body fins provides excellent heat conductibility between the blade assembly and clutch body, and the spider configuration of the blade assembly aids in the dissipation of heat between the clutch body and the atmosphere.

After mounting the blade assembly upon the body by an interference fit, the end of the collar 32 is preferably deformed inwardly to form a lip 36 by a rolling operation as appreciated in FIG. 1 whereby the lip 36 will be in axial alignment with the fin shoulder 18. This relationship prevents the blade assembly from moving to the right, FIG. 1, on the body sufficiently to permit the blade assembly to separate from the body. Movement of the blade assembly on the body 10 to the left, FIG. 1, is prevented by thermal clutch mounting structure, not shown, disposed adjacent the body 10.

The aforedescribed assembly of the blade assembly and body permits the blade assembly to be rigidly mechanically affixed to the body in a concentric relationship without requiring secondary operations on the body, and the only secondary operation required is the rolling over of the lip 36. Accordingly, as the tooling for assembling the body and blade assembly will permit a uniform interconnection between the body and blade assembly, the likelihood of misassembly is substantially reduced over bolt-on type blade and body assembly constructions, and the practice of the invention reduces manufacturing and assembly costs while providing a superior thermal clutch or coupling and blade assembly. The intimate contact between the hub and clutch body fins transfers heat from the clutch body to the blade assembly spider construction aiding in dissipating the heat from the clutch body, increasing the durability of the clutch and allowing use of a lesser mass fan drive whereby higher horsepower fans may be driven by smaller sized clutches.

Variations of the basic inventive concept of mounting the blade assembly upon the clutch body by an annular hub or collar which closely mounts upon the exterior surface of the clutch body fins to permit a very concentric mounting of the blade assembly on the clutch body and significantly reduce the axial length of the clutch and blade assembly to permit installation in close quarters is shown in FIGS. 3–6.

Figure 3:
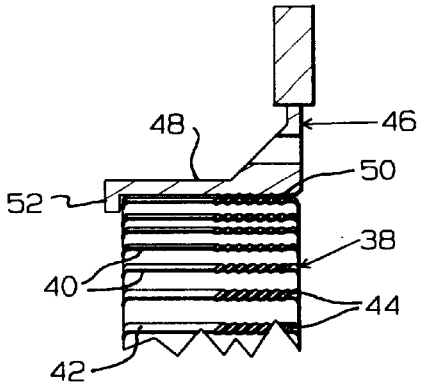
FIG. 3 is a detail view of another embodiment of blade assembly and clutch body utilizing threads wherein the blade assembly is shown in section.

In FIG. 3, the clutch body 38 includes cooling fins 40 having fin ends 42 defining a circular mounting surface for the blade assembly. The fin ends 42 are provided with threads 44 at least along a portion of the axial length of the fin ends. The blade assembly 46 includes the circular hub 48 having an inner diameter only slightly greater than the diameter of the fin ends, and the inner diameter of the hub 48 is threaded at 50 permitting the blade assembly 46 to be threaded upon the body 38 by engagement of the threads 44 and 50. The hub 48 also includes an inwardly extending lip 52 which extends over the left end, FIG. 3, of the hub 48 for engagement with the fins and limit movement of the blade assembly 46 to the right as the assembly is threaded upon fin threads 44. In this manner, the hub assembly may be firmly tightened on the clutch body 38 in a concentric manner adding little axial dimension to the overall clutch and blade assembly length, and providing a torque transmitting relationship between the clutch body and the blade assembly.

Figure 4:
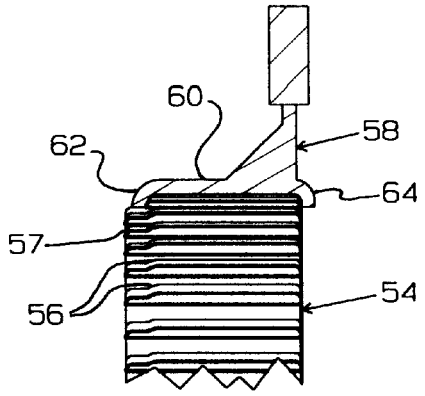
FIG. 4 illustrates another embodiment of mounting of the blade assembly upon the body fins' outer edges.

In FIG. 4, the clutch body is formed in a manner similar to that shown in FIG. 1 and includes a clutch body 54 having cooling fins 56 defined thereon. An annular shoulder 57 is defined in the fins. The blade assembly 58 includes a circular hub 60 which is preferably press fitted with an interference fit upon the outer ends of the fins 56. In order to prevent axial movement of the hub 60 on the fins 56 in the event of the interference fit failing, the hub 60 includes a lip 62 which is deformed inwardly about the shoulder 57, and an outer lip 64 is defined on the hub deformed inwardly along the side of the body fins. In this manner, the lips 62 and 64 prevent relative axial displacement between the clutch body and the blade assembly.

Figure 5:
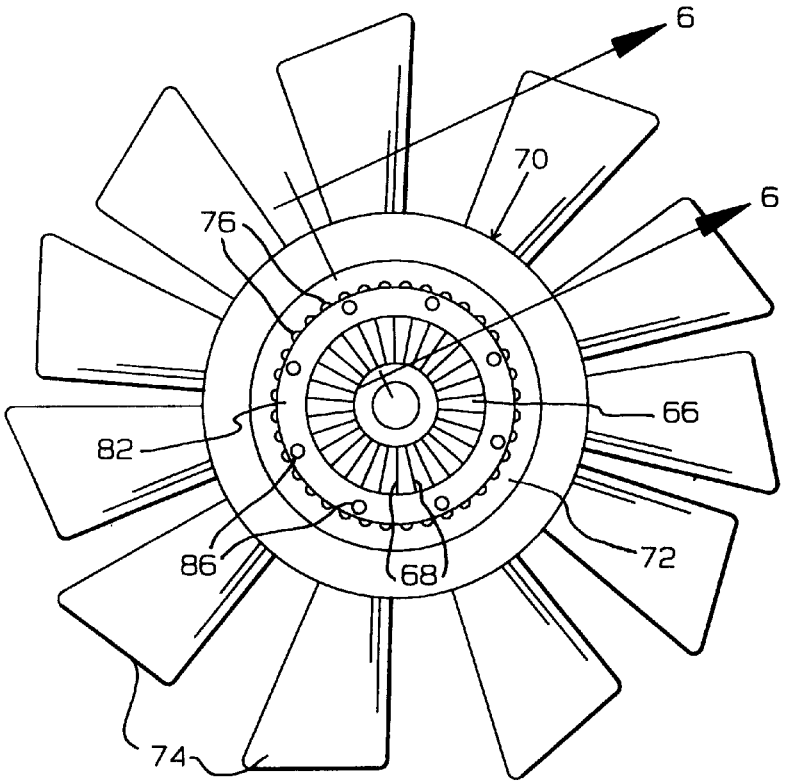
FIG. 5 is a front elevational view of yet another embodiment of the invention employing an annular ring and bolts.
Figure 6:
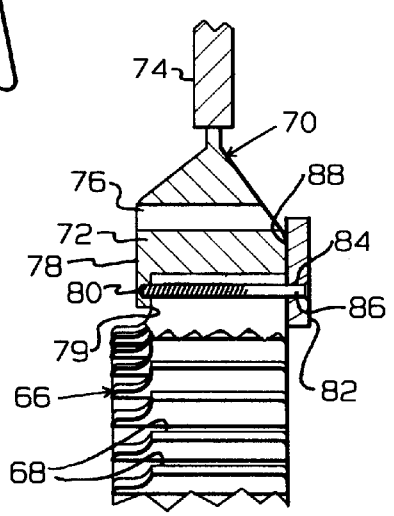
FIG. 6 is an elevational view, partially sectioned, as taken along Section 6—6 of FIG. 5.

An additional embodiment of the invention practicing the inventive concepts is shown in FIG. 5 wherein the clutch body is represented at 66 and the cooling fins at 68. The blade assembly 70 includes a plurality of blades mounted upon the hub 72. The blades 74 are preferably of a synthetic material molded upon the hub radial projections.

The hub 72 is provided with axially extending holes 76 permitting air to pass through the hub 72 for cooling purposes. The hub includes a lip 78 engaging the fin shoulder 79, and the inner surface of the hub 72 is closely received upon the outer edge of the fins 68, but not necessarily in an interference fit. The lip 78 is provided with a plurality of threaded holes 80 for a purpose described below.

An annular ring 82 is mounted upon the outer surface of the body 66, and the ring 82 includes a plurality of circumferentially spaced holes 86 receiving the threaded bolts 86. The bolts 86 extend between the fins 68 for threading into the hub lip threaded holes 80, and because the ring 82 overlaps the hub 72 at 88, tightening of the bolts 86 firmly draws the lip 78 into engagement with the shoulder 79 forming a concentric mounting of the hub 72 on the body 10 and permitting torque to be transferred between the body and the blade assembly.

Figure 7:
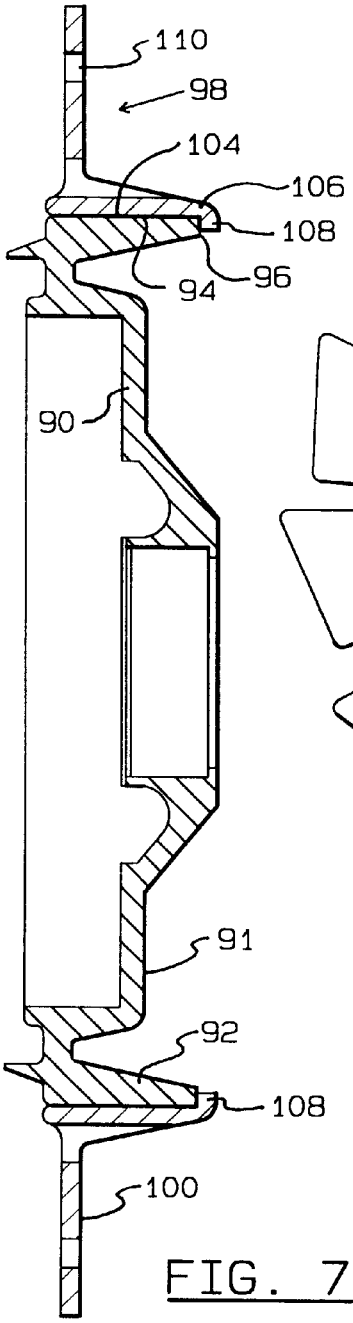
FIG. 7 is a diametrical elevational sectional view of another embodiment of a clutch body configuration and blade assembly wherein an interference fit is used to mount the blade assembly upon the clutch body.
Figure 8:
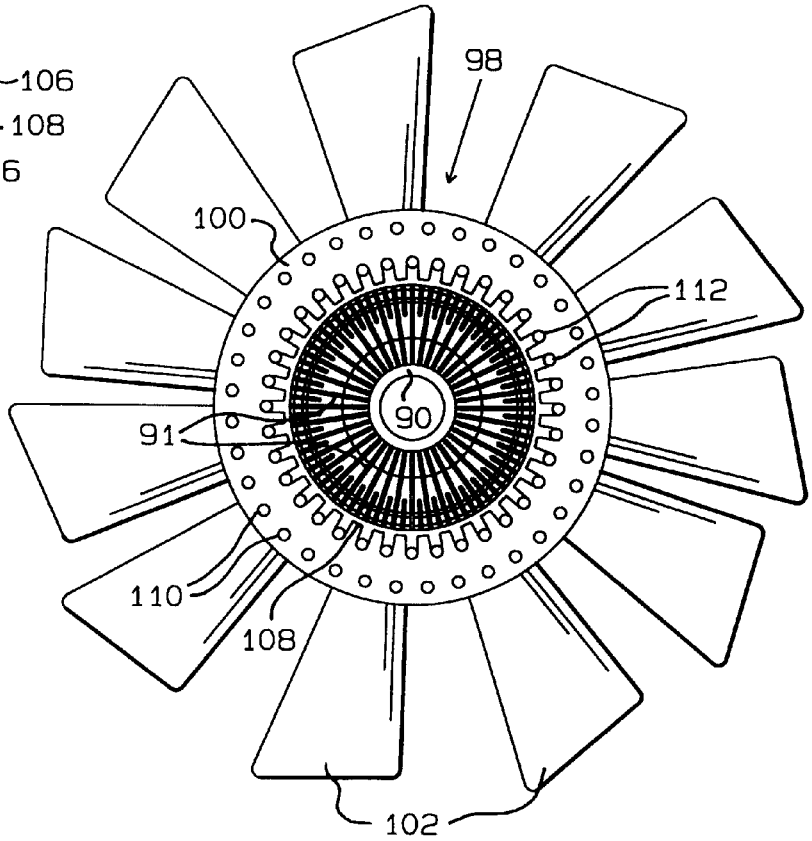
FIG. 8 is a front elevational view of a clutch body and blade assembly using the structure of FIG. 7.

Another embodiment utilizing the inventive concepts of the invention is shown in FIGS. 7 and 8. In this embodiment, the clutch body 90 includes fins 91 located on its outer surface, and an annular outer ring 92 is defined adjacent the periphery of the body 90 homogeneously of the body material. The outer ring 92 forms the cylindrical outer peripheral surface 94 which intersects the radially extending shoulder 96, FIG. 7.

The blade assembly 98 includes the annular hub 100 to which the radially extending blades 102 are mounted either by projections, not shown, or molded thereon. The inner surface 104 of the hub 100 is of a cylindrical configuration of slightly less diameter than the body peripheral surface 94 wherein the blade assembly hub 100 may be pressed upon the body surface 94 in an interference fit as shown in FIG. 7. In this manner, the blade assembly 98 is mechanically affixed to the clutch body 90 in a positive manner and the cylindrical surfaces 94 and 104 will engage each other throughout their configuration.

A plurality of fingers 106 are defined on the blade assembly hub 100, FIG. 8, and these fingers are bent inwardly to define a lip 108 which engages the body radial shoulder 96 to resist axial movement of the hub assembly 98 to the left on the body 90, FIG. 7. To aid in the cooling of the body 90, holes 110 are defined in the hub 100, while the hub inner holes 112 define the separation between the fingers 106.

Figure 2:
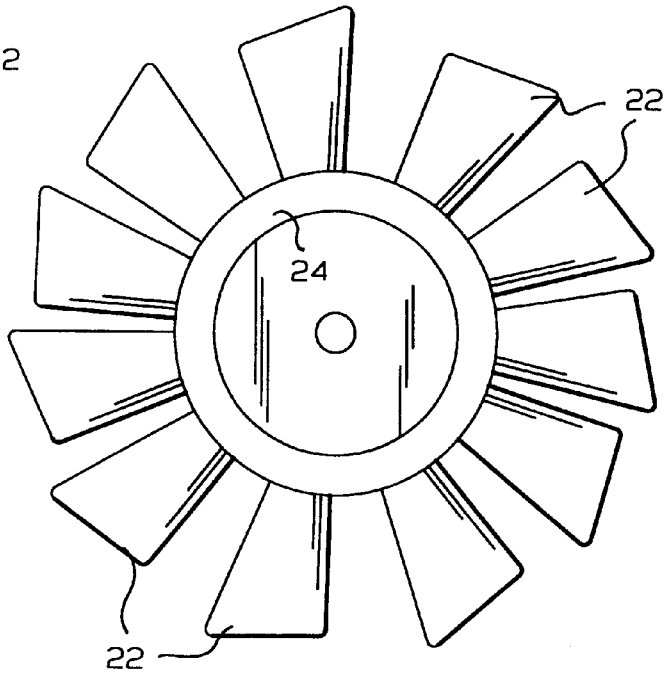
FIG. 2 is a front elevational view of FIG. 1 as taken from the right thereof.

The specially shaped body 90 of FIGS. 7 and 8 will provide a firmer connection between the blade assembly and the clutch body than the interference fit assembly shown in the embodiment of FIGS. 1 and 2 wherein no modification has been made to the clutch body or rotor. However, the embodiment of FIGS. 7 and 8 requires special tooling and molds as compared to the previously described embodiment utilizing interference fits.

It is appreciated that other modifications to the inventive concepts may be apparent to those skilled in the art without departing from the spirit and scope of the invention.

We claim:

1. In combination, a thermal clutch for liquid cooled internal combustion engines having a body rotatable about an axis upon the engine requiring cooling, said body having a metal external circular surface concentric to said axis, a fan blade unit including a hub having an axis and a plurality of fan blades extending from said hub in a direction radial with respect to said hub axis, said hub including a metal cylindrical mounting surface concentric to and facing said hub axis, said metal hub mounting surface being closely mounted upon said body metal external surface whereby said thermal clutch body and fan blade unit are concentric to each other, and torque transfer means transferring torque between said clutch body and said blade assembly.

2. In combination, a thermal clutch for liquid cooled internal combustion engines having a body rotatable about an axis upon the engine requiring cooling, said body having an external circular surface concentric to said axis, a fan blade unit including a hub having an axis, and a plurality of fan blades extending from said hub in a direction radial with respect to said hub axis, said hub including a cylindrical mounting surface concentric to and facing said hub axis, said hub mounting surface being closely mounted upon said body external surface whereby said thermal clutch body and fan blade unit are concentric to each other, and torque transfer means transferring torque between said clutch body and said blade assembly, said torque transfer means comprising an interference fit between said body external circular surface and said hub mounting surface.

3. In a combination as in claim 2, said hub including an inner edge adjacent said external surface, a shoulder defined on said thermal clutch body, said hub inner edge being deformed inwardly to axially align with said shoulder in an abutting relationship preventing removal of said hub mounting surface from said body external surface.

4. In combination, a thermal clutch for liquid cooled internal combustion engines having a body rotatable about an axis upon the engine requiring cooling, said body having an external surface concentric to said axis, a plurality of spaced cooling fins defined on said clutch body substantially concentric to said axis, said fins including outer edges, at least some of said fins' outer edges being an equal distance from said body axis to define a circular external body surface, a fan blade unit including a hub having an axis and a plurality of fan blades extending from said hub in a direction radial with respect to said hub axis, said hub including a mounting surface concentric to and facing said hub axis, said hub mounting surface being mounted upon said some fins' outer end edges defining said external body surface whereby said thermal clutch body and fan blade unit are concentric to each other, and torque transfer means transferring torque between said clutch body and said blade assembly.

5. In a combination as in claim 4, wherein said torque transfer means comprises an interference fit between said body external circular surface and said hub mounting surface.

6. In a combination as in claim 5, said hub including an inner edge adjacent said external surface, a shoulder defined on said thermal clutch body, said hub inner edge being deformed inwardly to axially align with said shoulder in an abutting relationship preventing removal of said hub mounting surface from said body external surface.

7. In a combination as in claim 4, first threads defined upon said some fins' outer edges, second threads defined upon said hub mounting surface, said first and second threads engaging to mount said hub upon said body fins, and axial movement limiting means defined on said hub engaging with said fins upon said hub being fully threaded upon said body fins.

8. In a combination as in claim 5, said hub including an inner edge and an outer edge axially spaced from said inner edge, axially spaced shoulders defined on said thermal clutch body, said hub inner edge being deformed inwardly to axially align with one of said body shoulders and said hub outer edge being deformed inwardly to axially align with the other of said hub shoulders whereby said axial alignment of said shoulders with said hub inner and outer edges prevents axial displacement between said hub and said fins.

9. In a combination as in claim 4, a radially extending lip defined on said hub extending radially inwardly of said fins' outer edges, a threaded hole defined in said lip, an annular ring engaging said fins on the opposite axial side thereof with respect to said lip, said ring radially overlapping said fins and said hub, and threaded fasteners extending through said ring threaded into said threaded holes defined on said lip whereby tightening of said fasteners axially restrains said hub with respect to axial displacement upon said fins' outer edges.

10. In a combination as in claim 9, said threaded fasteners extending between adjacent fins radially inwardly of said fins' outer edges whereby said fasteners constitute said torque transfer means transmitting torque between said clutch body and said blade assembly.

* * * * *